US007655097B2

(12) United States Patent
Fujita et al.

(10) Patent No.: US 7,655,097 B2
(45) Date of Patent: Feb. 2, 2010

(54) METHOD OF WASHING SOLID GRAIN

(75) Inventors: Hideaki Fujita, Okayama (JP); Hiroshi Machida, Okayama (JP); Nobuo Namiki, Okayama (JP); Yoshio Waguri, Okayama (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 10/571,015

(22) PCT Filed: Sep. 30, 2004

(86) PCT No.: PCT/JP2004/014773

§ 371 (c)(1),
(2), (4) Date: Mar. 8, 2006

(87) PCT Pub. No.: WO2005/032736

PCT Pub. Date: Apr. 14, 2005

(65) Prior Publication Data

US 2006/0254622 A1 Nov. 16, 2006

(30) Foreign Application Priority Data

Oct. 3, 2003 (JP) ..... 2003-345667

(51) Int. Cl.
*B08B 3/04* (2006.01)

(52) U.S. Cl. ..... 134/25.1; 134/10; 134/26; 134/34; 134/36; 134/42; 210/675; 210/678; 210/679; 210/772; 210/800; 210/801; 210/805

(58) Field of Classification Search ..... 210/675, 210/678, 679, 772, 800, 801, 805; 134/10, 134/25.1, 26, 34, 36, 42
See application file for complete search history.

(56) References Cited

U.S. PATENT DOCUMENTS 3,309,177 A * 3/1967 Goerg ..... 422/279

(Continued)

FOREIGN PATENT DOCUMENTS

EP 0175401 3/1986

(Continued)

OTHER PUBLICATIONS

Malaysian Official Action for Application No. PI 20044042, dated Dec. 19, 2007.

(Continued)

*Primary Examiner*—Sharidan Carrillo
(74) *Attorney, Agent, or Firm*—Antonelli, Terry, Stout & Kraus, LLP.

(57) ABSTRACT

In the washing process of the invention, the solid particles in a high-concentration zone, which is formed in a washing tank by a gravitational sedimentation of solid particles, are continuously washed by a counter-current contact with upward flow of a washing liquid which is fed from the bottom portion of the washing tank. With this process, the impurities in the solid particles are sufficiently removed by a simple apparatus. Since the used washing liquid can be recycled as the disperse medium for feeding the solid particles and as the washing liquid, the amount of used washing liquid to be discharged as the waste from the system is reduced.

10 Claims, 5 Drawing Sheets

U.S. PATENT DOCUMENTS

| | | | | | |
|---|---|---|---|---|---|
| 3,683,018 | A | * | 8/1972 | Longland, Jr. | 562/414 |
| 3,905,894 | A | * | 9/1975 | Hukki | 209/17 |
| 4,098,873 | A | | 7/1978 | Hollingsworth | |
| 4,174,281 | A | * | 11/1979 | Dell | 210/786 |
| 4,268,690 | A | * | 5/1981 | Komatsu et al. | 562/416 |
| 4,357,475 | A | * | 11/1982 | Hanotier et al. | 562/414 |
| 5,340,406 | A | | 8/1994 | Fearon | |
| 5,516,447 | A | * | 5/1996 | Bauer et al. | 510/535 |
| 5,684,187 | A | * | 11/1997 | Ohkoshi et al. | 562/486 |
| 5,777,161 | A | * | 7/1998 | Inary | 562/485 |
| 6,874,644 | B1 | | 4/2005 | Wagener et al. | |
| 2004/0139988 | A1 | | 7/2004 | Haubs et al. | |
| 2007/0015935 | A1 | * | 1/2007 | Fujita et al. | 562/410 |

FOREIGN PATENT DOCUMENTS

| | | | |
|---|---|---|---|
| EP | 0 622 121 | | 11/1994 |
| EP | 1 669 140 | | 6/2006 |
| EP | 1 669 343 | | 6/2006 |
| GB | 728791 | | 4/1955 |
| JP | 01-1690942 | * | 6/1989 |
| JP | 09-286758 | * | 4/1997 |
| JP | 09-286759 | * | 4/1997 |
| WO | WO 97/14765 | | 4/1997 |
| WO | WO 00/56417 | | 9/2000 |
| WO | WO 02/47795 | | 6/2002 |

OTHER PUBLICATIONS

Supplementary European Search Report for Application No. EP 04 77 3647, dated Jan. 30, 2008.

* cited by examiner

METHOD OF WASHING SOLID GRAIN

TECHNICAL FIELD

The present invention relates to a process for washing solid particles, and more particularly to a process for efficiently washing solid particles with a reduced amount of a washing liquid.

BACKGROUND ART

The washing of solid particles with a washing liquid has been frequently carried out in the production of organic and inorganic chemical products. Recently, soils contaminated with harmful substances such as dioxin are washed with a washing liquid such as water for regeneration.

The washing of solid particles basically includes a step for transferring impurities in the solid particles into a washing liquid and a step for separating the solid particles from the washing liquid. In the former stage, the impurities are removed from the solid particles by dissolution into the washing liquid or by dispersion into the washing liquid after divided into finer particles. A tank equipped with a stirrer has been frequently used to enhance the removing efficiency and to increase the transferring speed of the impurities into the washing liquid. The impurities can be almost completely transferred into the washing liquid by modifying the structure of the washing tank and controlling the residence time of the solid particles therein.

In the latter stage, the solid particles are separated by discarding the supernatant after allowing a slurry to stand or by a solid-liquid separation method such as filtration and centrifugal precipitation. However, a some amount of the washing liquid is generally retained in the solid particles separated by these separation methods. The washing liquid itself retained in the solid particles is removed by drying, but impurities in the washing liquid remains in the solid particles without being evaporated to result in an insufficient removal of the impurities.

Therefore, to sufficiently remove the impurities by washing the solid particles, it is required to reduce the amount of the washing liquid that accompanies the solid particles during the separation procedure. To enhance the effect of washing the solid particles, there has been used a separator in which a washing liquid containing impurities is removed by sprinkling a fresh washing liquid on the separated particles in the separator. However, such a separator involves problems that the structure is complicated and a sufficient washing effect is not obtained when the size of solid particles are small. Another approach for enhancing the effect of washing the solid particles is a washing method using a combination of a number of washing tanks and separators. Since the centrifugal separators and rotary filter separators which are frequently used in industrial processes are expensive, the method using a number of these apparatuses increases installation costs. In addition, there is proposed a method of sufficiently washing solid particles using a number of liquid cyclones (JP 5-140044 A). The cyclone itself is an inexpensive separator having a simple structure. However, a number of pumps are required to recycle the washing liquid, this making the overall system complicated. Therefore, the proposed method is not necessarily inexpensive. Further, the proposed method is not applicable to solid particles that are easily crushed because the particles are crushed in pumps and cyclones. Therefore, it has been demanded to develop a method of sufficiently washing solid particles by using an apparatus with simpler structure.

Another problem to be solved upon washing solid particles is to reduce the amount of a used washing liquid to be discharged as the waste. In the washing of crystals for the production of chemical products and the washing of contaminated soil as described above, the direct discharge of the used washing liquid causes environmental pollution. To avoid this problem, the used washing liquid should be discharged after decomposing the impurities or making the impurities harmless by chemical or biochemical treatments. It is advantageous for the decomposition or the treatment of making harmless that the amount of the waste liquid is smaller and the impurities are more concentrated therein, because the size of apparatus can be reduced and the energy required can be saved. In case of the removal of harmful substances such as dioxin which must be removed to an extremely low concentration, the waste liquid is difficult to be made harmless efficiently with low costs by the conventional methods, because the amount of the waste liquid is large and the concentration of impurities in the waste liquid is low. For example, a waste water of the same amount as that of soil being washed must be made harmless (Example 1 of JP 2001-113261 A), or a washing water three times the amount of soil to be washed is required (Examples of JP 2001-47027).

DISCLOSURE OF INVENTION

An object of the present invention is to provide a process capable of sufficiently removing impurities in solid particles by washing the solid particles with a washing liquid in a simple apparatus and capable of reducing the amount of a used washing liquid to be discharged as the waste.

As a result of extensive researches in view of solving the above problems in the washing of solid particles, the inventors have found that the impurities in the solid particles are sufficiently removed and the amount of a used washing liquid to be discharged is considerably reduced by feeding the solid particles and the washing liquid into a washing tank to form a high-concentration zone of the solid particles in the washing tank and bringing the solid particles into counter-current contact with an upward flow which is formed by a part of the washing liquid fed. The present invention has been accomplished on the basis of this finding.

Thus, the invention provides a process for continuously washing solid particles comprising:

(1) feeding the solid particles into a washing tank from an upper portion thereof and allowing the solid particles to gravitationally sediment, thereby forming a high-concentration zone of the solid particles in the washing tank;

(2) feeding a washing liquid into the washing tank from a bottom portion thereof so that a part of the washing liquid fed forms an upward flow;

(3) bringing the solid particles into counter-current contact with the upward flow of the washing liquid;

(4) discharging washed solid particles as a slurry together with a part of remainder of the washing liquid; and (5) separating the washed solid particles from the slurry.

With the continuous washing method of solid particles of the invention, the impurities in the solid particles are sufficiently removed and the amount of a used washing liquid to be discharged as the waste is reduced. Therefore, the costs for treating the used washing liquid is reduced to provide an industrially quite advantageous washing method of solid particles. In addition, the mother liquor left after separating the washed solid particles from the slurry can be used as the disperse medium for the solid particles to be fed into the washing tank from its upper portion or as the washing liquid to be fed into the washing tank from its bottom portion.

BEST MODE FOR CARRYING OUT THE INVENTION

Figure 1:
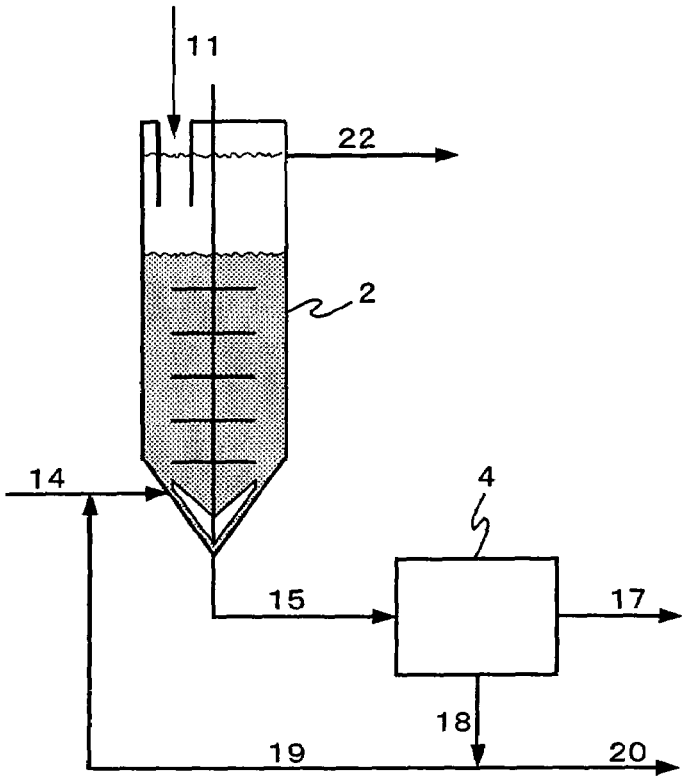
FIG. 1 is a schematic illustration showing a process for washing solid particles according to the present invention.

The washing operation of the solid particles referred to herein includes operations generally employed to reduce the content of impurities in the solid particles by using a washing liquid, such as an operation of removing impurities attached to the solid particle surface by dissolving the impurities in a washing liquid, an operation of removing impurities inside the solid particles by extracting the impurities with a washing liquid, and an operation of obtaining washed solid particles by separating a solvent containing impurities from a slurry produced by the chemical reaction in the solvent.

The shape and structure of the washing tank used in the present invention is not particularly limited. For example, the vertical washing tanks 2, 34 shown in FIGS. 1-3 and 7 may be preferably used.

The continuous washing of solid particle of the invention will be roughly described below. The solid particles are fed into the washing tank as they are (FIG. 1) or in a slurry form (FIGS. 2, 3 and 7) from a feed port at an upper portion of the washing tank. The solid particles fed are allowed to gravitationally sediment in the washing tank to form a high-concentration zone of solid particles. The washing liquid is fed into the washing tank from its bottom portion. A part of the washing liquid fed forms an upward flow which is then brought into counter-current contact with the solid particles in the high-concentration zone to wash the solid particles. The washed solid particles are discharged from the bottom portion of the washing tank as a slurry together with a part of the remainder of the washing liquid. After the counter-current contact, the upward flow of the washing liquid further rises to drain from a used washing liquid outlet at the upper portion of the washing tank. In case of feeding the solid particles in a slurry form together with a disperse medium, a major part of the disperse medium in the slurry drains from the used washing liquid outlet together with the upward flow of the washing liquid. The washing tank is generally operated at 0 to 230° C. under 0 to 10 MPaG (gauge pressure).

To reduce the amount of solid particles draining from the used washing liquid outlet, it is preferred to dispose the used washing liquid outlet at a portion higher than the position of the solid particle/slurry feed port. In the washing tank shown in FIG. 1 for directly feeding the solid particles as they are, the lower end of the solid particle feed port is preferably positioned below the used washing liquid outlet. With such a construction described above, the solid particles are washed while preventing the impurity-rich liquid at the upper portion of the washing tank from flowing down to mix with the liquid at the bottom portion.

In the process of the present invention, it is important to form a high-concentration zone of solid particles in the washing tank. The high-concentration zone may be formed by controlling the discharge amount of the slurry from the bottom portion of the washing tank. If the concentration of the solid particles in the high-concentration zone is too low, the solid particles and the liquid therein undergo a vigorous convection mixing to reduce the effect of removing impurities. If the concentration of solid particles is too high, the blocking of solid particles and the clogging of the slurry discharge port come to easily occur to make a stable operation difficult. The concentration of solid particles in the high-concentration zone is preferably 15 to 50% by volume.

Figure 5:
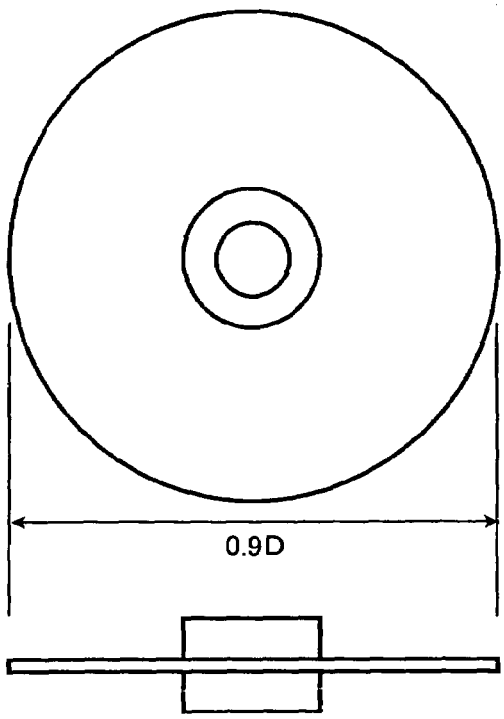
FIG. 5 is a schematic illustration showing a stirring blade used in examples, in which the upper is a top plan view, the lower is a side view, and D is the inner diameter of washing tank.
Figure 6:
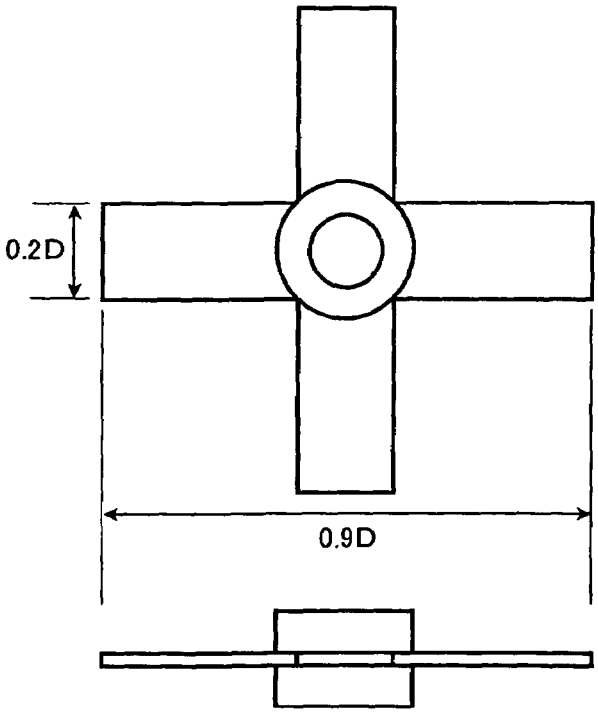
FIG. 6 is a schematic illustration showing another stirring blade used in examples, in which the upper is a top plan view, the lower is a side view, and D is the inner diameter of washing tank.
Figure 8:
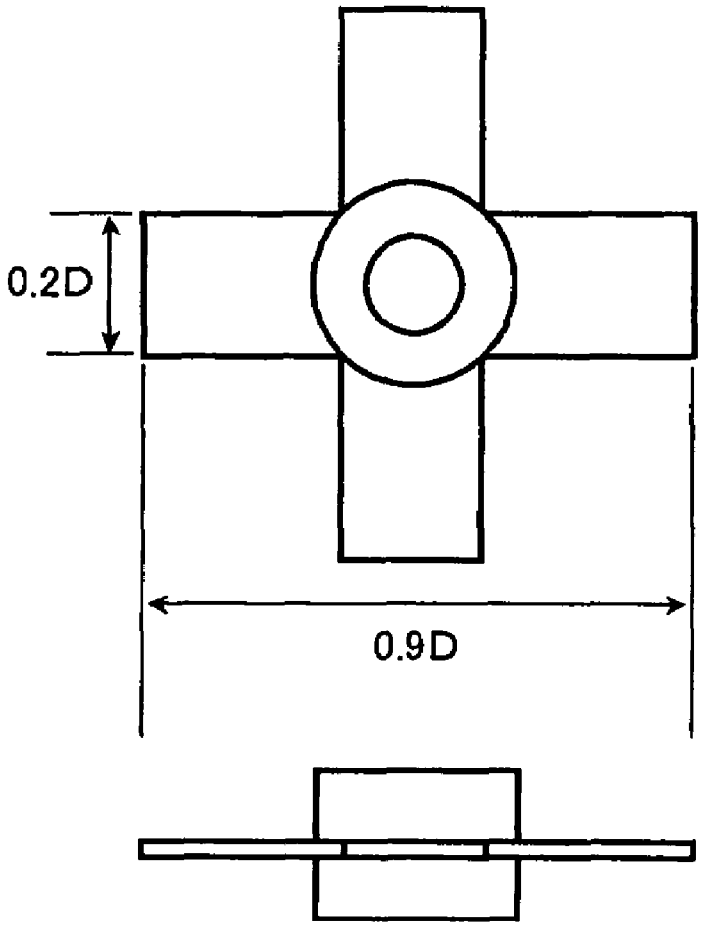
FIG. 8 is a schematic illustration showing a stirring blade used in Examples 8 and 9, in which the upper is a top plan view and the lower is a side view.

The concentration of solid particles in the high-concentration zone may be controlled by changing the feeding rates of solid particles and the washing liquid. To form a stable high-concentration zone over a wide ranges of the feeding rates, it is preferred to use a washing tank equipped with a stirrer. To prevent the flow of solid particles in the vertical direction, preferably used is a stirrer comprising a central shaft and a plurality of stirring blades which form horizontal circular flows by rotation and are fitted to the central shaft along its vertical direction. The shapes of the stirring blades capable of forming circular flow are illustrated in FIGS. 5, 6 and 8. The diameter of the stirring blade is preferably 0.5 to 0.99 time the inner diameter of the washing tank. The rotation speed of the stirring blade is preferably 0.2 to 5 m/s in terms of a peripheral speed of its tip end. If the rotation speed is too low, the effect of preventing the vertical convection flow of solid particles is lowered. If the rotation speed is too high, an excessive mixing is caused. In both cases, the effect of removing impurities is lowered. To prevent the deposition of solid particles at the bottom and the clogging of the slurry discharge port, a stirring blade having a different shape from the other blades, for example, a slant paddle blade and a turbine blade, may be used as the lowermost stirring blade which is disposed near the bottom of the washing tank.

To enhance the washing effect, it is preferred to increase the height of the high-concentration zone by increasing the height of the washing tank and to increase the number of stirring blades. The number of stirring blades to be generally used is 1 to 30. The stirring blades are arranged at interspaces of a given level or more, preferably 0.1 to 2 times and more preferably 0.2 to 1.5 times the diameter of the washing tank. The height of the high-concentration zone (from the bottom of washing tank to its upper surface) is preferably 0.5 to 0.95 time the height of the used washing liquid outlet form the bottom of washing tank. In case of using a washing tank equipped with a central shaft having a plurality of stirring blades, the height of the high-concentration zone is preferably 1.03 to 1.5 times the uppermost blade from the bottom of washing tank.

The flow rate of the upward flow of washing liquid is one part by weight or less and preferably 0.5 part by weight or less per one part by weight of the solid particles being treated. The smaller the amount of the upward flow of washing liquid is, the more preferred, because some portion of the upward flow are discharged as the waste out of the system. However, since an excessively low flow rate reduces the effect of removing impurities, the flow rate is preferably 0.01 part by weight or more per one part by weight of the solid particles being treated. The flow rate (upward linear velocity) exceeding zero is enough to form the upward flow of washing liquid, and the upper limit is preferably about 3.3 m/h.

The slurry discharged from the washing tank is introduced into the solid-liquid separator. In case of operating the washing tank under high-temperature and high-pressure conditions, a storage tank is preferably disposed before the solid-liquid separator to reduce the temperature and pressure of slurry to suitable levels for treatments in the solid-liquid separator. The storage tank is not required if the solid-liquid separator is operable under high-temperature and high-pressure conditions. Examples of the solid-liquid separator include a centrifugal sediment separator, a centrifugal filter separator, a vacuum filter and a pressure filter, although not limited thereto. Since the slurry is continuously discharged from the washing tank, the solid-liquid separator to be used is preferably of a type capable of continuously receiving the slurry and continuously discharging a separated cake and a mother liquor. The mother liquor left after separating the solid particles from the slurry may be recycled as the washing liquid for the solid particles. If the disperse medium is the same as the washing liquid, the mother liquor may also be recycled as the disperse medium.

Next, the solid particles, the washing liquid and the disperse medium suitably usable in the present invention will be explained.

The solid particles are allowed to gravitationally sediment in the washing process of the invention. If the size of the solid particles is too small, the sedimentation velocity is low to result in the failure in treating a sufficient amount of solid particles. On the contrary, if the size is too large, the sedimentation velocity of the solid particles becomes too high to result in the failure in attaining a sufficient washing effect. Therefore, the size of solid particles is preferably 0.01 to 5 mm and more preferably 0.02 to 2 mm in terms of a median diameter on volume basis. If the solid particles to be washed have a particle size distribution, fine particles escape in some cases from the used washing liquid outlet together with the upward flow of the washing liquid. Particles having a diameter of 0.005 mm or less usually escape from the used washing liquid outlet together with the upward flow of the washing liquid without sedimenting, although depending upon the properties of the washing liquid and the disperse medium for slurry. If the escape of fine particles should be prevented, the lower limit of the particle size distribution is preferably 0.005 mm or more.

The content of impurities tends to increase with decreasing particle size in some cases. This may be because that the finer the particles, the larger the surface area becomes to let the impurities adhere or attach more easily, or that the finer the particles, the larger the amount of liquid retained in the solid particles after solid-liquid separation. Therefore, if the fine particles containing the impurities in a relatively high content escape, the content of impurities of the solid particles discharged from the bottom portion of the washing tank is reduced to enhance the washing effect. Therefore, if the amount of fine particles escaping together with the used washing liquid is within the tolerable range, the escape thereof creates rather beneficial results.

Examples of the solid particles to be washed include aromatic polycarboxylic acids that are aromatic hydrocarbons having one or more aromatic rings such as benzene, naphthalene and biphenyl having their aromatic rings substituted by two or more carboxyl groups.

As the benzene polycarboxylic acids, preferred are isophthalic acid, etc. except for terephthalic acid. Examples of the naphthalene polycarboxylic acids include naphthalene dicarboxylic acids, naphthalene tricarboxylic acids and naphthalene tetracarboxylic acids, with naphthalene dicarboxylic acids being preferred because of their utility as raw materials for polyesters, urethanes and liquid crystal polymers, and 2,6-naphthalene dicarboxylic acid being more preferred. Examples of the biphenyl polycarboxylic acids include biphenyl dicarboxylic acids, biphenyl tricarboxylic acids and biphenyl tetracarboxylic acids, with biphenyl dicarboxylic acids being preferred because of their utility as raw materials for polyesters, polyamides and liquid crystal polymers, and 4,4'-biphenyl dicarboxylic acid being more preferred.

Taking the dissolving power to the solid particles and the impurities to be removed, the specific gravity and the viscosity into consideration, the washing liquid is selected from water, aliphatic carboxylic acids such as acetic acid, aliphatic hydrocarbons, aromatic hydrocarbons, esters such as carboxylic esters, alcohols, ketones, etc. Preferably, the washing liquid has a sufficient dissolving power to the impurities to be removed from the solid particles, but has a dissolving power not so high to the solid particles to be washed. More specifically, it is more preferred that the washing liquid dissolves the impurities completely at the operating temperature of washing tank, and that the dissolving power to the solid particles to be washed is less than 10 g per 100 g of the washing liquid.

To allow the solid particles to gravitationally sediment, the specific gravity of the washing liquid should be less than the true specific gravity of the solid particles. The sedimentation velocity of the solid particles varies depending upon the specific gravity difference between the solid particles and the washing liquid and the viscosity of the washing liquid. Since a sedimentation velocity which is too high or too low brings about unfavorable results as mentioned above, the solid particles and the washing liquid are preferably combined so as to attain an appropriate sedimentation velocity. Specifically, preferred is a washing liquid allowing a terminal sedimentation velocity of preferably 0.0005 to 0.5 m/s, more preferably 0.001 to 0.15 m/s at the average particle size of solid particles.

The disperse medium used for feeding the solid particles in slurry form may be the same as or different from the washing liquid and may be selected like the washing liquid. If different from the washing liquid, it is preferred that the disperse medium and the washing liquid are mutually dissolved at any ratio to form a uniform solution.

To enhance the washing effect, additives such as surfactants may be added to the washing liquid or the disperse medium for slurry.

Figure 2:
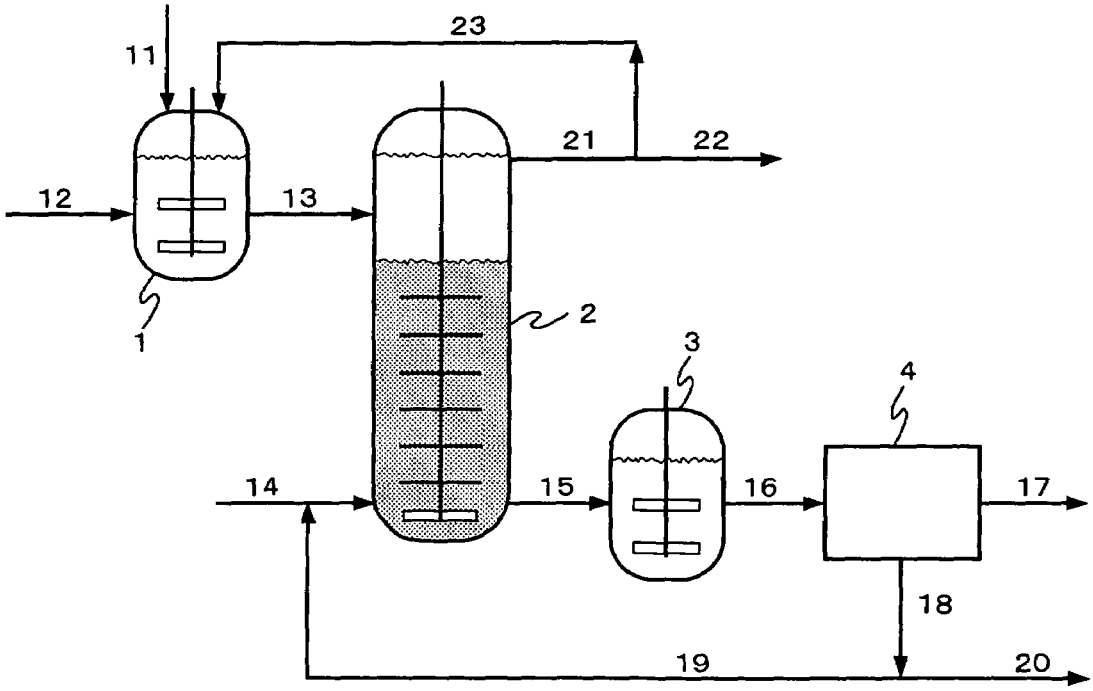
FIG. 2 is a schematic illustration showing a washing process in which solid particles are fed into a washing tank after mixed with a disperse medium in a slurry preparation tank and a mother liquor separated in a solid-liquid separator is recycled as a washing liquid.
Figure 3:
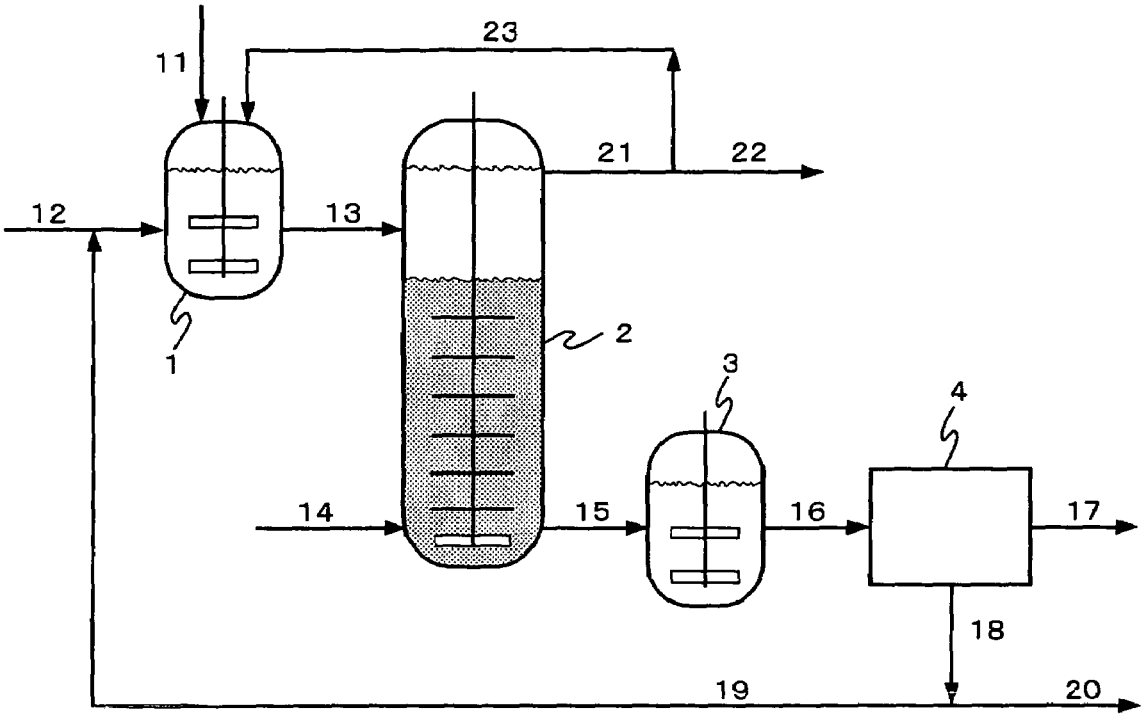
FIG. 3 is a schematic illustration showing a washing process in which solid particles are fed into a washing tank after mixed with a disperse medium in a slurry preparation tank and a mother liquor separated in a solid-liquid separator is recycled as a disperse medium for preparing a slurry.

The apparatus systems for practicing the washing process of the present invention are illustrated in FIGS. 1-3 and 7. FIG. 1 shows a washing process in which solid particles 11 are directly fed into a washing tank 2. FIGS. 2 and 3 show a process in which the solid particles 11 are mixed with a disperse medium 12 in a slurry preparation tank 1 and then fed into the washing tank 2. This process is suitable when the washing tank is operated under high-temperature and high-pressure conditions to enhance the washing effect and when the solid particles in a slurry obtained by a chemical reaction in a solvent are washed. In FIG. 2, a mother liquor 18 separated in a solid-liquid separator is recycled as a washing liquid 14, and in FIG. 3, the separated mother liquor 18 is recycled as the disperse medium 12 for slurry. In the process shown in FIG. 7, the slurry is fed into a washing tank 34 from a slurry preparation tank 31. In the attached drawings, a means for transporting liquid such as a pump and a heating or cooling device such as a heat exchanger are omitted. In FIGS. 1-4, like reference numerals indicate like parts.

Referring to FIG. 2, the invention is explained in more detail below. The solid particles 11 are fed into the slurry preparation tank 1 and mixed with the disperse medium 12. In the process for washing the solid particles in a slurry obtained by a chemical reaction in a solvent, the reference numerals 11, 12 and 1 respectively correspond to a raw material for the solid particles, a reaction solvent and reactor.

The structure of the slurry preparation tank is not particularly limited as long as its size is sufficient to prepare a slurry by mixing the solid particles and the disperse medium. To intimately mix the solid particles and the disperse medium and prevent the deposition or aggregation of the solid particles, a stirrer may be provided in the slurry preparation tank.

The slurry from the preparation tank 1 is fed to the washing tank 2 through a line 13. The solid particles fed to the washing tank 2 are allowed to gravitationally sediment while forming a high-concentration zone of the solid particles in the washing tank, and finally discharged as a slurry with a washing liquid 14 from a bottom portion of the washing tank through a line 15. A major part of the disperse medium 12 in the slurry drains through a line 21 from a used washing liquid outlet which is located above the slurry feed port. The washing liquid 14 is fed from the bottom portion of the washing tank 2. A part of the washing liquid 14 rises as an upward flow in the washing tank. The upward flow of the washing liquid is brought into a counter-current contact with the solid particles 11 and then drains from the used washing liquid outlet. In this manner described above, the solid particles are washed while preventing the impurity-rich liquid at the upper portion of the washing tank from coming down to mix with the liquid at the bottom portion.

The slurry discharged from the bottom portion of the washing tank is fed into a solid-liquid separator 4 through a line 15, a slurry storage 3 and line 16 and separated into a cake 17 and a mother liquor 18. By removing the washing liquid retained in the separated cake 17, the washed solid particles are obtained as the final product. A part of the mother liquor 18 from the solid-liquid separator may be recycled as the washing liquid 14 through a line 19, or as the disperse medium 12 for preparing the slurry as shown in FIG. 3. The mother liquor which is not recycled is discharged from the system through a line 20. As the amount of mother liquor recycled increases, the amount of mother liquor discharged as the waste from the system is preferably reduced. In the process of the invention, substantially the complete amount of the separated mother liquor can be recycled.

A part of the used washing liquid 21 draining from the used washing liquid outlet of the washing tank 2 may be recycled through a line 23 as the disperse medium 12 for preparing the slurry. As the recycled amount increases, the impurities are concentrated more in the used washing liquid 21 to facilitate the treatment for making the impurities harmless. In addition, the amount of used washing liquid 22 to be discharged from the system is reduced. If the washing liquid is expensive and noxious to the environment, the impurities in the used washing liquid should be separated or decomposed for regeneration or reuse of the washing liquid without discharging the used washing liquid from the system. The used washing liquid is regenerated, for example, by distillation. Therefore, it is quite advantageous that the amount of used washing liquid is small, because the energy required for regeneration can be saved and the size of regeneration facilities can be reduced.

The present invention will be described in more detail by reference to the examples, but it should noted that the examples are not intended to limit the invention thereto.

EXAMPLE 1

Using the apparatus shown in FIG. 1, the experiment for removing impurities attached to the surface of solid particles was conducted. As the solid particles, quartz sand (Ube Sand #7, average particle size=0.10 mm, true specific gravity=2.6) available from Ube Sand Kogyo Co., Ltd. was used. To determine the effect of removing impurities, the quartz sand was immersed in an aqueous sodium chloride solution, subjected to solid-liquid separation, and then dried to obtain raw solid particles, which were fed to the washing tank. The sodium ion content of the raw solid particles was 830 ppm by weight. Water was used as the washing liquid.

The washing tank comprised a cylindrical portion having an inner diameter of 300 mm and a conical bottom portion, and had a slurry discharge port at its lowermost portion. The cylindrical portion was 2,000 mm long and had a feed port for solid particles at its top surface. A used washing liquid outlet was disposed 200 mm below the top surface of the washing tank. The lower end of the nozzle of the feed port for solid particles was located 400 mm below the top surface of the washing tank. The washing tank was fitted with a central shaft having nine stirring blades (blade diameter=270 mm) shown in FIG. 5 at interspaces of 150 mm and one flat paddle blade as the lowermost blade which had a shape along the bottom portion at the lowermost position.

The slurry discharged from the bottom portion of the washing tank was fed to the solid-liquid separator by a pump (not shown). The solid-liquid separator used was a centrifugal precipitation type. The separated solid particles were dried and then measured for attached sodium ions.

After filling the washing tank with water, the raw solid particles and the washing water were fed at respective rates of 100 parts by weight/h and 20 parts by weight/h while rotating the stirrer at 60 rpm. A high-concentration zone of solid particles was formed in the washing tank without discharging the slurry from the bottom portion. When the upper surface of the high-concentration zone reached 200 mm above the uppermost stirring blade, the discharge of the slurry from the bottom portion and the feeding of the slurry to the separator were started. The mother liquor obtained in the separator was completely recycled to the washing tank as the washing liquid through the recycling line. Thereafter, the washing tank was continuously operated while controlling the amount of the slurry discharged from the bottom portion so as to maintain the upper surface of the high-concentration zone at constant level, and simultaneously, controlling the feeding amount of washing water so as to allow the used washing liquid to drain from the used washing liquid outlet in a rate of about 10 parts by weight per one hour. During the operation, the concentration of solid particles in the high-concentration zone was 25 to 26% by volume.

The separated solid particles were dried and measured for the water content and the residual sodium ion concentration. The water content was 5 to 6% by weight and the sodium ion concentration was 5.2 to 6.1 ppm on the washed solid particles sampled after reaching a stable operation and dried. The removal of sodium ions based on the raw solid particles was 99.27 to 99.37%.

Comparative Example 1

Figure 4:
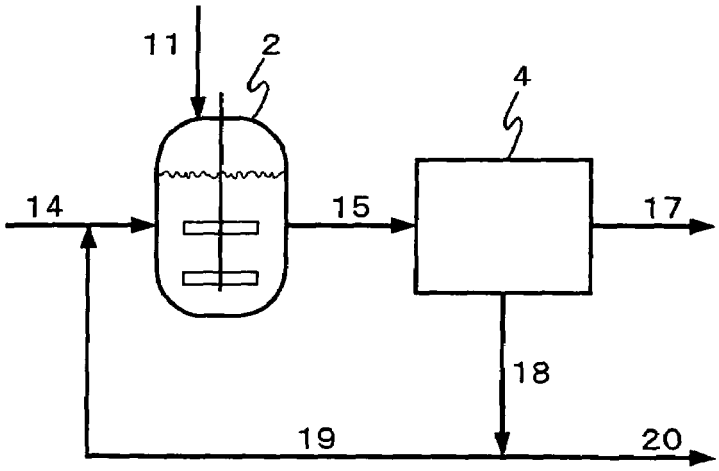
FIG. 4 is a schematic illustration showing a process for washing solid particles employed in Comparative Examples 1 and 2, in which a combination of a common washing tank and solid-liquid separator is used.

Using an apparatus for washing solid particles comprising a combination of a common washing tank and a common solid-liquid separator as shown in FIG. 4, an experiment for evaluating the effect of removing impurities was conducted. The washing tank was equipped with a stirrer having slant paddle blades. The solid-liquid separator was the same type as used in Example 1. The same solid particles as used in Example 1 and a washing water were fed to the washing tank at respective rates of 100 parts by weight/h and 250 parts by weight/h. The discharged slurry was fed to the separator by a pump. The separated mother liquor (about 240 parts by weight) was not reused and completely discharged from the system.

The separated solid particles were analyzed in the same manner as in Example 1. The water content was 5 to 6% by weight, the sodium ion concentration was 17 to 20 ppm, and the removal of sodium ions was 97.6 to 97.9%.

The amount of the used washing liquid discharged from the system was very large and the removal of impurities was low as compared to those of Example 1.

Comparative Example 2

The procedure of Comparative Example 1 was repeated except that the washing liquid was fed at a rate of 15 to 16 parts by weight/h and a part of the separated mother liquor was discharged from the system at a rate of 10 parts by weight/h while recycling the remainder to the washing tank.

The water content was 5 to 6% by weight, the sodium ion concentration was 280 to 320 ppm, and the removal of sodium ions was 33 to 38%.

Although the amount of the used washing liquid discharged from the system was nearly the same as in Example 1, the removal of impurities was considerably poor.

EXAMPLE 2

The procedure of Example 1 was repeated except that the feeding amount of the washing water was controlled so as to allow the used washing liquid to drain at a rate of about 30 parts by weight/h.

The sodium ion concentration was 0.58 to 0.63 ppm and the removal of sodium ions was 99.92 to 99.93%.

EXAMPLE 3

The procedure of Example 1 was repeated except that a part of the mother liquor separated in the separator was discharged from the system at a rate of 10 parts by weight/h while recycling the remainder as the washing water.

The sodium ion concentration was 1.8 to 2.1 ppm and the removal of sodium ions was 99.75 to 99.78%.

EXAMPLE 4

The procedure of Example 1 was repeated except for changing the number of stirring blades to five and the interspaces to 300 mm. The removal of sodium ions was 98.2 to 98.3%.

EXAMPLE 5

The procedure of Example 1 was repeated except for changing the rotation speed of stirring blade to 150 rpm (peripheral speed of the tip end of blade=2.1 m/s). The removal of sodium ions was 97.3 to 97.5%.

EXAMPLE 6

The procedure of Example 1 was repeated except for using the stirring blades shown in FIG. 6. The removal of sodium ions was 97.2 to 97.8%.

Comparative Example 3

The procedure of Example 1 was repeated except for changing the feeding amount of solid particles to 250 parts by weight/h and the draining amount of used washing liquid to 30 parts by weight/h. During the operation, the concentration of solid particles in the high-concentration zone was about 14% by volume.

The water content was 5 to 7%, the sodium ion concentration was 150 to 170 ppm, and the removal of sodium ions was 79 to 82%.

Comparative Example 4

The procedure of Example 1 was repeated except for changing the rotation speed of the stirrer to 10 rpm (peripheral speed of the tip end of blade=0.14 m/s). The removal of sodium ions of 76 to 80%.

EXAMPLE 7

The procedure of Example 1 was repeated except for changing the quartz sand to granular alumina (average particle size=0.20 mm; specific gravity=2.0). The granular alumina fed had a sodium ion concentration of 970 ppm.

The water content was about 6%, the sodium ion concentration was 8.3 to 8.8 ppm, and the removal of sodium ions was 99.09 to 99.14%.

EXAMPLE 8

Figure 7:
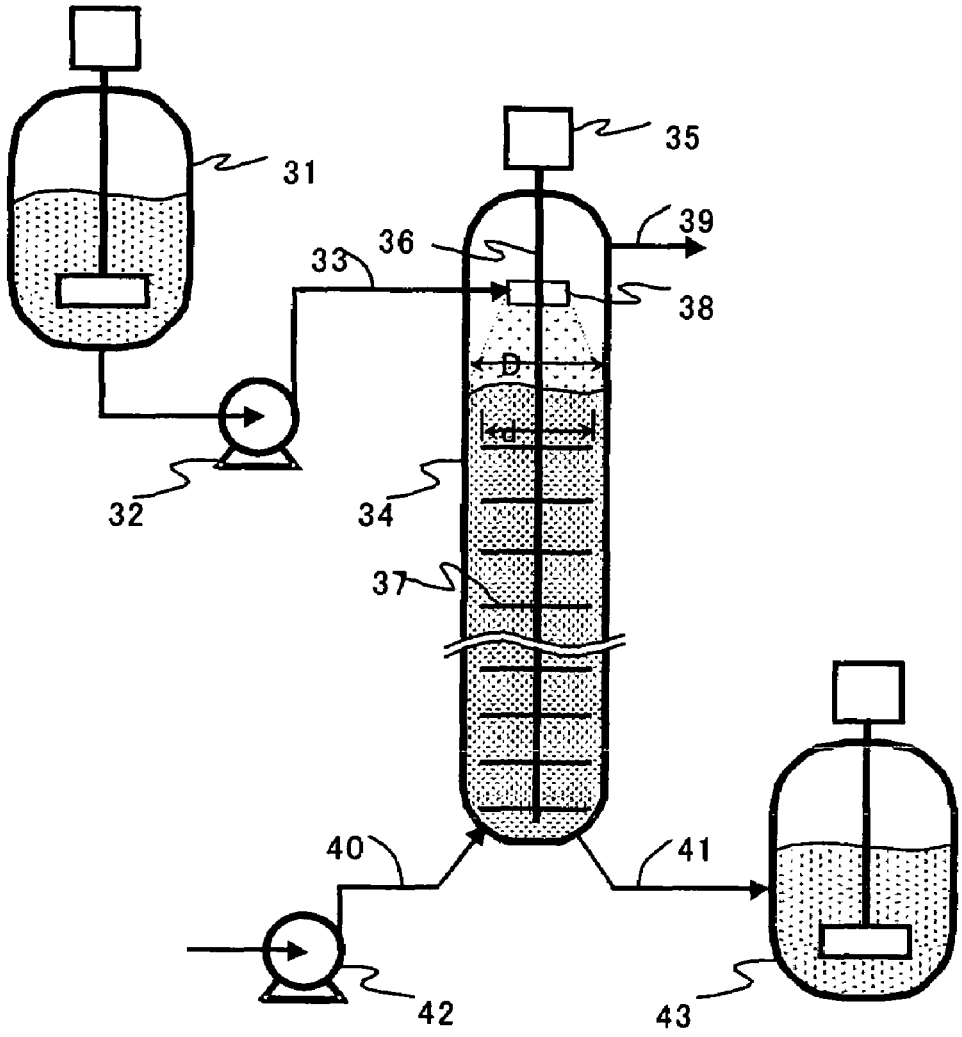
FIG. 7 is a schematic illustration showing a washing apparatus used in Examples 8 and 9.

Using the apparatus shown in FIG. 7, an acetic acid solvent slurry (crude slurry) of crude isophthalic acid crystals obtained by the liquid-phase oxidation of m-xylene was washed with water. The crude slurry was produced in industrial scale by oxidizing m-xylene at 200° C. in a water-containing acetic acid solvent in the presence of an oxidation catalyst comprising cobalt, manganese and a bromine compound while blowing air into the solvent. The concentration of isophthalic acid crystals in the crude slurry was 30% by weight, and the mother liquor after removing the crystalline component consisted of 86% by weight of acetic acid and 14% by weight of water.

Referring to FIG. 7, the crude slurry in a preparation tank 31 was fed to an upper portion of a washing tank 34 through a line 33 by driving a pump 32. The washing tank 34 was constructed by a titanium cylinder having an inner diameter D of 36 mm and equipped with a stirring shaft 36 connected to a motor 35. The stirring shaft 36 was provided with fifteen stirring blades 37 at 50-mm interspaces at its portion below a feed port for the crude slurry. The stirring blades shown in FIG. 8 were used. The diameter d of the stirring blade was 32 mm, being about 0.9 time the inner diameter D. An outlet pipe 39 for used washing liquid was disposed at the top portion of the washing tank 34. At the bottom portion of the washing tank 34, a feeding pipe 40 for the washing liquid and a discharging pipe 41 for the washed slurry were disposed. The washing liquid was fed to the washing tank 34 by means of a pump 42. In the lines 33, 40 and 41, flow meters and flow control valves (not shown) were provided. In a line 39, a valve (not shown) for controlling the inner pressure of the washing tank was provided.

First, the washing tank was filled with water of 90° C. by driving the pump 42. When water began to overflow from the outlet pipe 39 for used washing liquid, the feeding amount of water was controlled so as to adjust the upward linear velocity of water flow to 0.5 m/h. Then, the shaft 36 and the stirring blades 37 were rotated at 120 rpm by driving the motor 35. The peripheral speed of the tip end of stirring blade was 0.20 m/s. Next, the pump 32 was operated to feed the crude slurry of 160° C. from a feeding nozzle 38 through the line 33 at a flow rate of 8.3 kg/h.

When it was confirmed by the monitor using a powder level detector that the height of the high-concentration zone reached 50 mm above the uppermost stirring blade, the feeding amount of the washing water was increased and the discharge of the slurry from the bottom portion of washing tank was started. The discharged slurry was stored in a storage tank 43. The amount of the slurry being discharged was controlled so as to maintain the height of the high-concentration zone at the intended level, and simultaneously, the amount of the washing water being fed was controlled so as to maintain the upward linear velocity of water flow at the intended level (0.5 m/h). The operation was continued for 4 h after the system was stabilized, and a sample was taken out of the discharged slurry. The sample was subjected to solid-liquid separation and dried to obtain isophthalic acid crystals. The hue of the crystals expressed by $OD_{340}$ was 0.71.

$OD_{340}$ is the absorbance at 340 nm and measured by a spectrophotometer on a filtrate in 50-mm quartz cell, which filtrate was prepared by dissolving 5.0 g of isophthalic acid crystals in 30 ml of 3N ammonia water and filtering through a 5-μm membrane filter.

Separately, an acetic acid solvent slurry of isophthalic acid produced in industrial scale was subjected to solid-liquid separation using a rotary vacuum filter (RVF) and then dried to obtain crude isophthalic acid crystals. $OD_{340}$ was 2.42.

EXAMPLE 9

Using the apparatus shown in FIG. 7, an acetic acid solvent slurry (crude slurry) of crude 2,6-naphthalenedicarboxylic acid crystals obtained by the liquid-phase oxidation of 2,6-dimethylnaphthalene was washed with water. The crude slurry was produced in pilot apparatus by oxidizing 2,6-dimethylnaphthalene at 200° C. in a water-containing acetic acid solvent in the presence of an oxidation catalyst comprising cobalt, manganese and a bromine compound while blowing air into the solvent. The concentration of 2,6-naphthalenedicarboxylic acid crystals in the crude slurry was 28% by weight, and the mother liquor after removing the crystalline component consisted of 88% by weight of acetic acid and 12% by weight of water.

The procedure of Example 8 was repeated except for feeding the crude slurry of 190° C. at a rate of 50 g/h. The operation was continued for 4 h after the system was stabilized, and a sample was taken out of the discharged slurry. The sample was subjected to solid-liquid separation and dried to obtain 2,6-naphthalenedicarboxylic acid crystals. The hue of the crystals expressed by $OD_{400}$ was 0.78.

$OD_{400}$ is the absorbance at 400 nm and measured by a spectrophotometer on a filtrate in 10-mm quartz cell, which filtrate was prepared by dissolving 1.0 g of 2,6-naphthalenedicarboxylic acid crystals in 10 ml of 1N NaOH aqueous solution and filtering through a 5-μm membrane filter.

Separately, an acetic acid solvent slurry of 2,6-naphthalenedicarboxylic acid produced in industrial scale was subjected to solid-liquid separation using a basket centrifugal separator and then dried to obtain crude 2,6-naphthalenedicarboxylic acid crystals. $OD_{400}$ was 2.13.

INDUSTRIAL APPLICABILITY

The process of the present invention is applicable to various washing operations such as an operation of removing impurities attached to the solid particle surface by dissolving the impurities in a washing liquid, an operation of removing impurities inside the solid particles by extracting the impurities with a washing liquid, and an operation of obtaining washed solid particles by separating a solvent containing impurities from a slurry produced by the chemical reaction in the solvent. Thus, the invention is industrially useful.

What is claimed is:

1. A process for continuously washing solid particles comprising:

(1) feeding solid particles into a washing tank from an upper portion thereof and allowing the solid particles to gravitationally sediment, and forming a high-concentration zone of the solid particles in the washing tank, wherein a concentration of the solid particles in the high-concentration zone is 15-50% by volume, wherein the high-concentration zone is stirred by a stirrer, the stirrer having a disc-form stirring blade, wherein a rotation speed of the stirrer is controlled to a speed in a range of 0.84 to 5 m/s, in terms of a peripheral speed of its tip end, and wherein the stirring is made so as to form circular flows in the high-concentration zone by the stirrer, the stirrer comprising a stirring shaft extending, in a vertical direction and a plurality of stirring blades fitted to the stirring shaft along the vertical direction;

(2) feeding a washing liquid into the washing tank from a bottom portion of the washing tank so that a part of the washing liquid fed forms an upward flow;

(3) bringing the solid particles into counter-current contact with the upward flow of the washing liquid to wash the solid particles;

(4) discharging the washed solid particles as a slurry together with a part of a remainder of the washing liquid; and (5) separating the washed solid particles from the slurry, wherein a height of the high-concentration zone, from a bottom of the washing tank, is 0.5 to 0.95 times a height, from the bottom of the washing tank, of an outlet of the washing liquid from the washing tank, after the washing liquid has been used to wash the solid particles.

2. The process according to claim 1, wherein the solid particles are fed to the washing tank as a slurry together with a disperse medium.

3. The process according to claim 1, wherein a part of a mother liquor left after separating the washed solid particles from the discharged slurry is recycled as the washing liquid.

4. The process according to claim 1, wherein the solid particles are aromatic polycarboxylic acid crystals.

5. The process according to claim 1, wherein the washing tank has a length extending in the vertical direction, the stirring being made to form horizontal circular flows in the high-concentration zone.

6. The process according to claim 1, wherein the washing liquid, after being used to wash the solid particles, is discharged from the washing tank from a location of the washing tank higher than a location at which the solid particles are fed to the washing tank.

7. The process according to claim 1, wherein a lowermost stirring blade, of the plurality of stirring blades, has a shape different from that of other stirring blades of the plurality of stirring blades.

8. The process according to claim 1, wherein a height, from the bottom of the washing tank, of the high-concentration zone is 1.03 to 1.5 times a height, from the bottom of the washing tank, of an uppermost stirring blade of the plurality of stirring blades.

9. The process according to claim 1, wherein the rotation speed of the stirrer is controlled to a speed in a range of 2.1 to 5 m/s, in terms of a peripheral speed of its tip end.

10. The process according to claim 2, wherein a part of a mother liquor left after separating the washed solid particles from the discharged slurry is recycled as the disperse medium.

* * * * *